US006397663B1

(12) United States Patent
Chatelet

(10) Patent No.: US 6,397,663 B1
(45) Date of Patent: Jun. 4, 2002

(54) SEALING DEVICE FOR THE END PORTIONS OF ROD-SHAPED SMOKERS' PRODUCTS HAVING NON-CIRCULAR CROSS-SECTIONAL OUTLINES

(75) Inventor: Jacquest Chatelet, Saclay (FR)

(73) Assignee: Decouflé s.a.r.l. (FR)

( * ) Notice: Subject to any disclaimer, the term of this patent is extended or adjusted under 35 U.S.C. 154(b) by 0 days.

(21) Appl. No.: 09/453,203

(22) Filed: Dec. 3, 1999

(30) Foreign Application Priority Data

Dec. 3, 1998 (DE) ..... 198 55 747

(51) Int. Cl.[7] ..... G01M 3/04; G01M 3/26; G01M 15/08

(52) U.S. Cl. ..... 73/49.8; 73/38; 73/71; 131/904

(58) Field of Search ..... 73/38, 41, 45, 73/49.8; 131/904; 211/70.3

(56) References Cited

U.S. PATENT DOCUMENTS

| | | | | |
|---|---|---|---|---|
| 3,948,084 A | | 4/1976 | Heitmann et al. | |
| 4,429,567 A | * | 2/1984 | Koch et al. | 73/49.8 |
| 4,630,466 A | * | 12/1986 | Berlin | 73/38 |
| 5,369,985 A | * | 12/1994 | Koch | 73/49.8 |

FOREIGN PATENT DOCUMENTS

| | | | | |
|---|---|---|---|---|
| DE | 3140812 A1 | * | 11/1980 | |
| GB | 2138266 | * | 10/1984 | 73/38 |

* cited by examiner

*Primary Examiner*—Hezron Williams
*Assistant Examiner*—Michael Cygan
(74) *Attorney, Agent, or Firm*—Venable; George H. Spencer; Robert Kinberg

(57) ABSTRACT

A conveyor for testing successive plain or filter cigarettes or other rod-shaped smokers' products having non-circular (such as oval) cross-sectional outlines employs a rotary drum-shaped conveyor for sidewise transport of smokers' products toward, through and beyond a station where the products are tested by streams of a gaseous fluid entering the products at one axial end and issuing from satisfactory products at the other axial end. The end portions of the products are sealingly received in complementary sockets of elastically deformable sealing sleeves which are connected to their tubular fluid-conveying carriers in a manner to ensure that each sleeve remains in a selected position for optimum testing of the products. For example, each sleeve can be form-lockingly coupled to its carrier in such a way that the sleeve is held against any appreciable angular and/or axial movement relative to the carrier when the conveyor transports smokers' products but that the sleeve can be detached from the carrier, in response to adequate deformation, for the purpose of inspection, cleaning and/or replacement.

9 Claims, 1 Drawing Sheet

SEALING DEVICE FOR THE END PORTIONS OF ROD-SHAPED SMOKERS' PRODUCTS HAVING NON-CIRCULAR CROSS-SECTIONAL OUTLINES

CROSS-REFERENCE TO RELATED CASES

This application claims the priority of German patent application Serial No. 198 55 747.7 filed Dec. 3, 1998. The disclosure of the above-referenced German patent application, as well as that of each U.S. and foreign patent and patent application mentioned in the specification of the present application, is incorporated herein by reference.

BACKGROUND OF THE INVENTION

The present invention relates to improvements in apparatus for manipulating elongated rod-shaped articles, and more particularly to improvements in apparatus for monitoring certain characteristics of rod-shaped articles by means of a pneumatic testing fluid. Still more particularly, the invention relates to improvements in substantially sleeve-like sealing devices which are utilized in such types of apparatus to establish fluid-conveying connections between the articles and the monitoring means during transport of articles past or through a testing station. The invention also relates to combinations of sealing devices with fluid-conveying parts in the above outlined apparatus.

Typical examples of rod-shaped articles or products which can be tested in the apparatus of the present invention are plain or filter cigarettes, cigars, cigarillos or other rod-shaped smokers' products as well as sections of filter rods for tobacco smoke.

It is customary to test successive rod-shaped smokers' products (hereinafter called cigarettes for short with the understanding that such term is to embrace all kinds of rod-shaped smokers' products which can be tested with a gaseous fluid medium) by resorting to a conveyor which transports the cigarettes toward, past and beyond a testing station. The end portions of the cigarettes are received in resilient (elastic) sleeves which couple them to fluid-admitting or fluid-receiving components of the testing apparatus. The testing operation can include a detection of the presence or absence of holes in the tubular wrappers of cigarettes, the quality of customary perforations which are provided in the wrappers to admit streamlets of cool atmospheric air into the column of tobacco smoke flowing into the mouth of the smoker of a lighted cigarette, the resistance which the so-called filler of a cigarette offers to the flow of a gaseous fluid and/or others. As a rule, or in many instances, compressed gaseous testing fluid is admitted into one end portion of a cigarette moving sideways through the testing satiny, and the characteristics of testing fluid issuing at the other end of the cigarette are examined for the purpose of ascertaining the quality of the tested product.

It is often sufficient to utilize for each cigarette on the testing conveyor a single resilient sleeve, e.g., a sleeve which ensures that compressed air supplied by a compressor or the like cannot escape into the atmospheres on its way into one end portion of a cigarette advancing toward the testing station. The sleeves are carried by the testing conveyor and are movable axially toward and away from sealing engagement with the adjacent end portions of the cigarettes which are about to be tested. The sleeves have round sockets for reception of end portions forming part of customary round (cylindrical) cigarettes, and oval sockets for reception of the end portions of so-called oval cigarettes (i.e., cigarettes having elliptical or substantially elliptical cross-sectional outlines). Reference may be had to U.S. Pat. No. 3,948,084 which fully describes several presently known and utilized testing conveyors for rod-shaped smokers' products.

A drawback of presently known testing apparatus which are utilized to ascertain certain characteristics of oval cigarettes is that the angular and/or axial positions of their resilient sealing sleeves do not invariably correspond to optimum angular and/or axial positions for predictable and damage-free introduction and/or extraction of end portions of oval cigarettes. It if often necessary to replace defective elastic sleeves with fresh sleeves, and each such operation can result in improper mounting of one or more sleeves. This contributes to the number of rejects. The likelihood of improper mounting of sleeves for the end portions of oval or like non-circular cylindrical cigarettes is less pronounced during assembly of a testing apparatus in the plant which turns out such apparatus; however, the likelihood of improper mounting (such as misalignment) of sleeves is much more pronounced in the cigarette making plant where the sleeves must be replaced at frequent intervals. The danger of improper mounting of fresh sleeves in a cigarette making plant is especially pronounced if such tasks are entrusted to unskilled or to freshly hired persons.

OBJECTS OF THE INVENTION

An object of the invention is to provide a novel and improved apparatus for pneumatically testing cigarettes and analogous rod-shaped products of the tobacco processing industry.

Another object of the invention is to provide novel and improved sealing devices for use in the testing apparatus.

A further object of the invention is to provide novel and improved combinations of sealing devices and carriers therefor which can be utilized in the above outlined testing apparatus.

An additional object of the invention is to provide a novel and improved testing conveyor which can be put to use in the above outlined apparatus to transport rod-shaped products of the tobacco processing industry toward, through and beyond a testing station where the products are tested with currents of a gaseous testing medium, such as air.

Still another object of the invention is to provide sleeve-like sealing devices for the end portions of oval cigarettes which are configurated in such a way that they can be properly mounted on tubular carriers only and alone if they assume optimum positions relative to their carriers in a testing conveyor.

A further object of the invention is to provide sealing devices which can be rapidly and predictably mounted in a testing apparatus even by unskilled persons.

Another object of the invention is to provide sealing devices for the end portions of oval cigarettes which are less likely to deform, deface and/or otherwise damage the end portions of cigarettes than heretofore known sealing devices.

SUMMARY OF THE INVENTION

One feature of the invention resides in the provision of a sealing sleeve for non-circular end portions of rod-shaped articles of the tobacco processing industry which advance with elongated tubular carriers on a rotary conveyor past a pneumatic testing station. The sleeve comprises an at least partially resilient body having at least one annular portion surrounding and form-lockingly engaging at least one tubular section of a carrier to thus maintain the sleeve in a predetermined position relative to the conveyor and relative to an end portion of an article being tested. If the articles are so-called oval cigarettes, cigars, cigarillos, filter mouthpieces or the like (i.e., if such articles have at least substantially elliptical cross-sectional outlines), the at least one annular portion of the sleeve can have an at least substantially oval outline.

The arrangement can be such that the at least one annular portion of the sealing sleeve has an internal profile which is complementary to an external profile of the respective carrier in at least one of the directions including circumferentially and longitudinally of the carrier. One of the profiles can include at least one protuberance (such protuberance can extend at least substantially radially of the carrier), and the other profile can include a complementary recess (e.g., a radially extending bore or hole) for the at least one protuberance.

The body of the sealing sleeve can have a second annular portion which is adjacent the at least one annular portion and is arranged to enter a complementary annular recess of the respective carrier to thus releasably hold the sealing sleeve and the carrier against movement relative to each other in the longitudinal direction of the carrier. The sleeve can be slipped off the carrier in response to requisite deformation of its at least partially resilient body.

Another feature of the present invention resides in the provision of a pneumatic testing apparatus for plain or filter cigarettes, cigars, cigarillos or filter mouthpieces for tobacco smoke having non-circular cross-sectional outlines. The testing apparatus comprises a conveyor (e.g., a drum having axially parallel peripheral flutes for the rod-shaped smokers' products to be tested) which is rotatable about a predetermined axis, a tubular carrier which is rotatable with the conveyor, and an at least partially resilient sealing sleeve having a socket (such as a recess in an end face of the sleeve) arranged to receive an end portion of a product to be tested and an internal profile surrounding and complementary to an external profile of the carrier to releasably hold the sleeve against movement in at least one of the directions including (a) axially of the conveyor and (b) circumferentially of the carrier.

The sleeve and/or the carrier can have an at least substantially oval cross-sectional outline.

The aforementioned profiles can be configurated to establish between the sleeve and the carrier a form-locking connection; such connection permits separation of the sleeve from the carrier and/or application or reapplication of the sleeve over the carrier in response to adequate deformation of the at least partially resilient sleeve.

One of the profiles can have at least one protuberance, and the other profile then exhibits a complementary recess for such protuberance.

It is also advisable to configurate the carrier and the sleeve in such a way that one of the profiles exhibits a ring-shaped projection and the other profile has a complementary annular groove for the ring-shaped projection to thus hold the sealing sleeve and the carrier against movement relative to each other in the axial direction of the conveyor; such axial movement is possible only in response to sufficient deformation of the sleeve.

The novel features which are considered as characteristic of the invention are set forth in particular in the appended claims. The improved sealing sleeve itself, however, both as to its construction and the mode of using the same in a testing apparatus, will be best understood upon perusal of the following detailed description of certain presently preferred specific embodiments with reference to the accompanying drawings.

DESCRIPTION OF PREFERRED EMBODIMENTS

Figure 1:
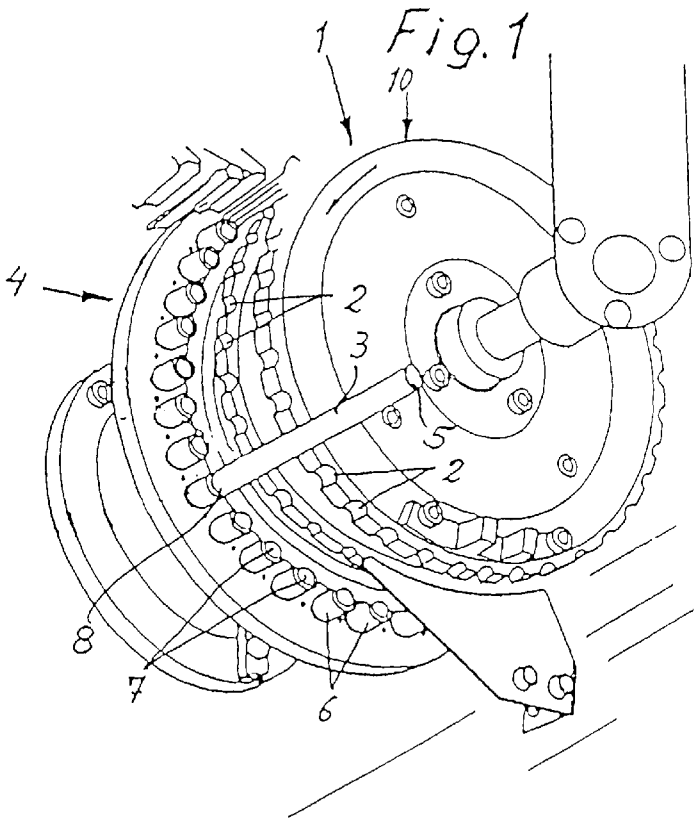
FIG. 1 is a fragmentary perspective view of a testing apparatus employing sealing devices which embody the present invention.

FIG. 1 shows a portion of a drum-shaped rotary testing conveyor 1 with receptacles in the form of axially parallel peripheral flutes 2 which serve to advance successive oval cigarettes 3 (only one shown) toward, past and beyond a testing station 4. When a cigarette 3 approaches the testing station. 4 (see the upper half of FIG. 2), one (8) of its end portions 5, 8 is at least partially received in an oval socket 7 in the exposed end face of a novel sealing sleeve 6 which is separably coupled with an elongated tubular carrier 12 orbiting about the rotational axis of the conveyor 1 when the apparatus embodying the-conveyor is in actual use.

Two sealing sleeves 6 are provided for each flute 2. Thus, during actual testing, each of the two end portions 5, 8 of a cigarette advancing past the testing station 4 is, sealingly received in the socket 7 of a discrete sealing sleeve 6. Since the sleeves 6 at one axial end of the conveyor are configurated, mounted and transported in the same way as those at the other axial end of the conveyor, FIG. 1 merely shows a portion of the annular array of parallel sleeves at the left-hand end of such conveyor.

Figure 2:
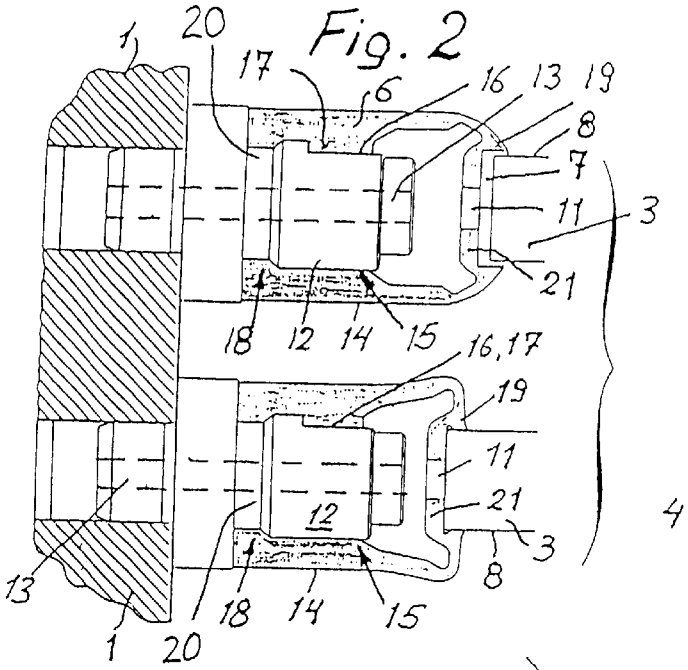
FIG. 2 is a greatly enlarged fragmentary sectional view of the apparatus showing one sealing device adjacent the testing station and another sealing device at the testing station.
Figure 3:
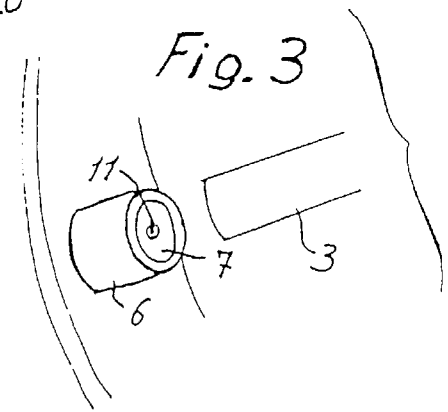
FIG. 3 is an enlarged fragmentary perspective view of a detail in the apparatus of FIG. 1.

Each sleeve 6 has a relatively short centrally located opening 11 which communicates with the socket 7 and serves to convey a testing fluid (such as air) into or from the adjacent end portion 5 or 8 of the cigarette 3, i.e., out of or into the axial bore 13 of the respective carrier 12. The manner in which a sleeve 6 approaches the adjacent end portion of an oval cigarette 3 is shown in FIG. 3. The upper portion of FIG. 2 shows the end portion 8 of a cigarette 3 partly in the socket 7 of the registering sleeve 6, and the lower half of FIG. 2 shows the end portion 8 in its final position of sealing engagement with the sleeve.

The conveyor 1 is provided with customary control slots (not shown) which supply testing fluid (such as compressed air) to carriers 12 supporting sealing sleeves 6 which are separably but sealingly connected with the end portions 5 or 8 of the cigarettes 3 advancing through the testing station 4. Additional slot or slots are provided to convey fluid which has passed through the cigarettes and has been discharged by way of the end portions 8 or 5 into the sleeves 6 at the other axial end 10 of the conveyor; this takes place downstream of the testing station and the fluid streams are monitored by suitable electrical, electronic or pneumatic testing devices which ascertain the qualities of the tested cigarettes and determine whether the tested cigarettes are transferred from the conveyor 1 onto a conveyor for transport to a packing machine, to a filter tipping machine or to storage. If the cigarettes are found to be defective, the signals from such monitoring means are utilized to segregate them from satisfactory cigarettes on the conveyor 1 or on a conveyor which (directly or indirectly) receives cigarettes from the conveyor 1. The manner of pneumatically or otherwise testing cigarettes or analogous rod-shaped smokers' products (including filter rod sections) is well known in the art and, therefore, such testing means are not shown in the drawings. Reference may be had to the aforementioned U.S. Pat. No. 3,948,084. Thus, the sleeves 6 can be caused to move toward sealing engagement with the adjacent end portions of the cigarettes 3 while the cigarettes are transported toward the testing station 4, the sleeves remain in reliable sealing engagement with the respective end portions of the cigarettes during advancement of cigarettes through the station 4, and the sleeves are thereupon moved axially and away from the cigarettes downstream of the testing station so that the tested cigarettes can be transferred from the conveyor 1. Movements of the sleeves 6 into and from sealing engagement with the adjacent end portions of the cigarettes 3 are preferably gradual. The freshly emptied flutes 2 of the conveyor 1 receive untested cigarettes 3 at a station which precedes the testing station 4 and follows the transfer station where the tested cigarettes are removed from the conveyor 1.

Each sealing sleeve 6 has or can have an oval cross-sectional outline, not only in the region around the socket 7 and the transverse partition 21 surrounding the opening 11, but also in the region surrounding the respective carrier 12. The at least partially resilient body of each sleeve 6 further comprises an annular portion 14 which snugly surrounds an annular section 15 of the respective carrier 12, as well as an annular portion 18 which snugly surrounds the annular section 20 of the carrier. The annular section 15 has a substantially radially inwardly extending recess 16 which snugly receives a complementary radially inwardly extending protuberance 17 of the annular portion 14; this can be seen in the lower half of FIG. 2. The annular section 20 defines a circumferential groove which receives the radially inwardly extending ring-shaped portion 18 of the sleeve 6.

The body of a sleeve 6 must be deformed (expanded) in order to slip the annular portion 18 over the section 15, and the annular portion 18 thereupon snaps into the groove of the annular section 20 to thus hold the sleeve against axial movement relative to the carrier 12. At the same time, the projection 17 of the annular portion 14 extends into the recess 16 of the section 15 to hold the sleeve against angular movement relative to the carrier 12. Thus, the internal profile of that part of the resilient body of a sleeve 6 which includes the portions 14, 18 and the external profile of that part of the carrier 12 which includes the sections 15 and 20 are such that the parts 6 and 12 are form-lockingly connected to each other. Such form-locking connection can be separated in response to temporary deformation (expansion) of the body of the sleeve so that the portion 18 can be extracted from the groove of the section 20 and that the protuberance 17 is expelled from the recess 17 of the section 15 prior to pulling of the expanded portion 18 of the sleeve off the carrier 12.

The axial bores 13 of the carriers 12 serve to convey a testing fluid from the end portions of the cigarettes 3 to the aforementioned control slots of the conveyor 1 or vice versa. The source of pneumatic testing fluid can constitute an air compressor (not shown) of the like.

Each sleeve 6 has an elastic annular lip 19 which extends forwardly beyond the partition 21 and surrounds the end portion 5 or 8 of the cigarette 3 which is aligned with the respective carrier 12. The lip 19 is of one piece with the peripheral portion of the partition 21 which is in sealing contact with the end face of the end portion 5 or 8 when the respective cigarette 3 is being tested at the station 4. At such time, the opening 11 conveys a testing fluid from the axial bore 13 of the carrier 12 into the end portion 5 or 8 of the cigarette 3, or the fluid flows from the end portion 5 or 8, through the opening 11 and into the bore 13. The sealing action between the internal surface of the annular lip 19 and the external surface of the end portion 5 or 8 of a cigarette 3 is enhanced if the end face of the end portion 5 or 8 bears upon the outer side of the partition 21 with a certain force. This enhances the quality of the testing operation because the interior of the end portion 5 or 8 is reliably sealed from the surrounding atmosphere. Thus, the testing fluid is compelled to flow from the bore 13 into the end portion 5 or 8 of a cigarette 3 or vice versa.

An important advantage of the improved sealing sleeves 6 and of the combinations of sealing sleeves 6 with the carriers 12 is that, once a sleeve 6 is mounted on (i.e., form-lockingly connected with) the adjacent carrier 12, the sleeve is necessarily held in an optimum position for proper sealing engagement with the end portion 5 or 8 of a cigarette 3. This is particularly important when the cigarettes 3 have non-circular cross-sections. For example, if the angular position of a conventional sleeve relative to its carrier is not predictable or happens to depart from an optimum position, a cigarette having an oval or elliptical cross-sectional outline is likely to be inserted into the socket of the sleeve in such a way that the major axis of the elliptical cross-sectional outline of an end portion of the tested rod-shaped article coincides with the minor axis of the elliptical cross-sectional outline of the socket in the end face of the sealing sleeve. This results in escape of testing fluid and/or, in penetration of atmospheric air with attendant distortion of the results of the testing operation. Moreover, such improper insertion of an oval end portion into an oval socket can result in undue deformation of or in other damage to the end portion of the tested article.

It is clear that the improved sleeve 6 and/or the improved combination of such sleeve with a carrier 12 is susceptible of numerous modifications without departing from the spirit of the present invention. For example, the internal protuberance 17 of the sleeve 6 can be replaced with an external protuberance of the section 15 of the carrier 12, and the recess 16 of the section 15 is then replaced with a recess in the internal profile of the portion 14 of the sleeve 6. Other types of form-locking connections can be utilized with equal advantage as long as they ensure adequate form-locking engagement between the carrier and the sealing sleeve, namely a part which is or which can be rigid (e.g., made of a suitable metal) and a part which is at least partially resilient to the extent which is necessary to permit a detachment of the sealing sleeve from its carrier.

Another important advantage of the improved sealing sleeve and of a combination of such sealing sleeve with a carrier 12 or an analogous carrier is that a sleeve can be rapidly form-lockingly connected to or separated from the carrier. Moreover, it is practically impossible to mount the sealing sleeve 6 in a non-acceptable or improper manner. This, in turn, reduces the likelihood of damage to the end portions of the articles being tested and/or the likelihood of unsatisfactory testing due to uncontrolled leakage of testing fluid into the surrounding atmosphere and/or due to uncontrolled penetration of atmospheric air into the articles advancing through the testing station.

The sealing sleeves can be made of rubber, foam rubber or any other suitable resilient (elastic) material, e.g., a wear-resistant synthetic plastic material.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of testing apparatus for cigarettes or the like and, therefore, such adaptations should and are intended to be comprehended within the meaning and range of equivalence of the appended claims.

What is claimed is:

1. A sealing sleeve for non-circular end portions of rod-shaped articles of the tobacco processing industry which advance with elongated tubular carriers on a rotary conveyor past a pneumatic testing station, comprising an at least partly resilient body having at least one annular portion surrounding, securing and form-lockingly engaging at least one tubular section of a carrier to thus maintain the sleeve in a predetermined position relative to the carrier and relative to an end portion of an article being tested, wherein said at least one annular portion has an internal profile which has a rotationally asymmetrical circumferential surface which is complementary to an external profile of the respective carrier to thus hold the sleeve against movement relative to the carrier in both the circumferential and longitudinal directions.

2. The sealing sleeve of claim 1, wherein said seal has a socket, which accommodates said rod-shaped articles having a substantially oval cross section.

3. The sealing sleeve of claim 1, wherein one of said profiles includes at least one protuberance and the other of said profiles includes a complementary recess for said at least one protuberance.

4. The sealing sleeve of claim 1, wherein said body has a second annular portion adjacent to said at least one annular portion and arranged to enter a complementary annular recess of the respective carrier to thus releasably hold the sleeve and the carrier against movement relative to each other in the longitudinal direction of the carrier.

5. A pneumatic testing apparatus for elongated rod-shaped smokers' products having non-circular cross-sectional outlines, comprising:

a conveyor rotatable about a predetermined axis;

a tubular carrier rotatable with said conveyor; and an at least partially resilient sealing sleeve separably connected with the carrier, said sleeve having a socket arranged to receive an end portion of a product to be tested and an internal profile surrounding and complementary to an external profile of the carrier to releasably hold the sleeve against movement both axially to the conveyor and circumferentially to the carrier.

6. The apparatus of claim 5, wherein said sealing sleeve accommodates said rod-shaped articles having a substantially oval cross section.

7. The apparatus of claim 5, wherein said profiles are configurated to establish form-locking connection between said sleeve and said carrier, said connection permitting separation of said sleeve from said carrier in response to deformation of said sleeve.

8. The apparatus of claim 5, wherein one of said profiles has at least one protuberance and the other of said profiles has a complementary recess for said at least one protuberance.

9. The apparatus of claim 5, wherein one of said profiles has a ring-shaped projection and the other of said profiles has a complementary annular groove for said projection to thus hold said sleeve and said carrier against movement relative to each other in the axial direction of the conveyor in the absence of deformation of said resilient sleeve.

* * * * *